United States Patent [19]

Künne et al.

[11] Patent Number: 4,866,908

[45] Date of Patent: Sep. 19, 1989

[54] TABLE-TOP MAIL EXTRACTION APPARATUS HAVING SEPARATE, CONNECTABLE POWER UNIT

[75] Inventors: Wolfgang Künne, Rellingen/Holstein; Bernd Lund, Hamburg, both of Fed. Rep. of Germany

[73] Assignee: Stielow GmbH, Norderstedt, Fed. Rep. of Germany

[21] Appl. No.: 150,381

[22] Filed: Jan. 29, 1988

[30] Foreign Application Priority Data

Feb. 21, 1987 [EP] European Pat. Off. ..... 87102460.0

[51] Int. Cl.[4] ..... B65B 43/30

[52] U.S. Cl. ..... 53/386; 53/167; 53/391; 53/381 R

[58] Field of Search ..... 53/381 R, 386, 384, 53/391, 390, 492, 167, 569, 266 A, 206

[56] References Cited

U.S. PATENT DOCUMENTS

| | | | |
|---|---|---|---|
| Re. 32,328 | 1/1987 | Russell | 53/381 R |
| 3,384,252 | 5/1968 | West | 53/381 R |
| 3,691,726 | 9/1972 | Stephens et al. | 53/381 R |
| 3,979,884 | 9/1976 | Russell | 53/381 R |
| 4,016,708 | 4/1977 | Dehart | 53/381 R |
| 4,050,222 | 9/1977 | Stephens et al. | 53/381 R |
| 4,056,921 | 11/1977 | Gilliand et al. | 53/167 |
| 4,110,958 | 9/1978 | Stevens | 53/386 |
| 4,124,968 | 11/1978 | Stevens et al. | 53/381 R |
| 4,159,611 | 7/1979 | Russell | 53/569 |
| 4,271,656 | 6/1981 | Russell | 53/381 R |
| 4,318,322 | 3/1982 | Russell | 83/94 |
| 4,333,300 | 6/1982 | Russell | 53/569 |
| 4,353,197 | 10/1982 | Stevens et al. | 53/492 |
| 4,388,793 | 6/1983 | Kunne | 53/381 R |

FOREIGN PATENT DOCUMENTS

| | | |
|---|---|---|
| 963126 | 4/1957 | Fed. Rep. of Germany . |
| 1006310 | 4/1957 | Fed. Rep. of Germany . |
| 267710 | 7/1950 | Switzerland . |

OTHER PUBLICATIONS

"The Stielow Incoming Mail Processor SESAM 2", Jan. 1987, No. 6.

Stephens Industries, Inc. Encorette 2000 Service Manual and Brochure, Envelope Contents Removal, The Automated System for Processing Incoming Mail (1979).

"Advanced Mail Processing", E. Gemske, Industrie-Anzeiger No. 42, 723-724 (1964), pps. 1-8 (English Translation and German language—attached).

*Primary Examiner*—James F. Coan

*Attorney, Agent, or Firm*—Staas & Halsey

[57] ABSTRACT

An apparatus for facilitating the extraction of the contents of envelopes includes a mail opening and extraction assembly which opens an envelope along at least one edge of the envelope and spreads apart the opened envelope to facilitate removal of the contents of the envelope. A power unit provides a source of electricity and fluid pressure, and a supply line couples the mail opening and extraction assembly to the power unit to transfer the electricity and fluid pressure to drive the mail opening and extraction assembly. The mail opening and extraction assembly includes a pivotable extraction surface having a first position substantially flush with a transfer surface and a second position in which the extraction surface is pivoted so as to be at an angle with respect to the transfer surface. The extraction station also includes a vacuum apparatus for spreading apart the envelope to expose the contents of the envelope. Specifically, a lower vacuum cup on the extraction surface contacts a first face of the envelope and an upper vacuum cup contacts a second face of the envelope. A vacuum arm extends from the vacuum cup and is movable in a direction away from the extraction surface to spread the envelope apart. The upper vacuum cup is rotatable about the axis of the vacuum arm so as to distort the envelope which is being spread apart to insure that the contents of the envelope do not cling to the inside surface of the envelope.

29 Claims, 5 Drawing Sheets

ON/OFF
AUTO OFFD
SPEED
DELAY
A

TABLE-TOP MAIL EXTRACTION APPARATUS HAVING SEPARATE, CONNECTABLE POWER UNIT

BACKGROUND OF THE INVENTION

This invention relates to mail extraction equipment and more particularly to mail extraction equipment which is capable of opening envelopes and spreading apart the opened envelopes at an extraction station to facilitate the removal of the contents of the envelope by an operator.

There exist, in the incoming mail processing art, a variety of types of equipment for processing incoming mail. This equipment ranges from very small electrically powered letter openers or slitters to very large systems for opening envelopes, extracting the contents of the envelopes and processing the extracted contents. In the mid-range of such incoming mail processing equipment, there are available a number of different types of mail extraction machines which are capable of opening one, two or three edges of an envelope and of either spreading the opened envelope apart for extraction of the contents of the envelope by an operator or transporting the envelope for further processing. One such apparatus is sold under the trademark SESAM 3 by Stielow GmbH of Norderstedt, West Germany, and is described in U.S. Pat. No. 4,388,793, issued June 21, 1983, the disclosure of which is hereby incorporated by reference. Mail extraction machines of the type described in U.S. Pat. No. 4,388,793 are typically equipped with one or more rows of sorting tray shelves or with auxiliary conveyors which may be attached to accommodate additional operators for segregation and filing of the incoming mail. Such equipment is capable of processing a relatively high volume of envelopes per hour, but the dimensions of such incoming mail processors are at least the size of a very large desk and, if equipped with auxiliary equipment, may extend to a length of several meters. Further, certain of the mail extraction machines currently on the market are only capable of handling letters having a narrow range of size and thickness. For example, some such machines can only handle envelopes which are a maximum of 2 mm thick. In addition, there is currently no machine on the market having a cost which is in between the very inexpensive electric letter openers and the moderately priced mail extraction machines of the type disclosed in U.S. Pat. No. 4,388,793.

As a result of a relatively small mail volume (e.g., 200 to 500 letters per day) and the expense of available mail extraction machines, many processors of incoming mail are forced to limit themselves to the inexpensive electrically powered letter openers, because the additional cost of a mail extraction machine cannot be justified in view of a low mail volume. Further, many companies have incoming mail processing which, by necessity or design, is spread out among a number of different departments. Therefore, while the overall volume of mail for the company may be quite large, the individual batches of mail which are processed in the separate departments may be relatively small, so that the cost of obtaining a mail extraction machine for each department which is opening mail, is not justified.

While available mail extraction machines perform their functions well, there is a need in the field of incoming mail processing for a more moderately priced mail extraction apparatus which is versatile with respect to the type of mail it will open, and which will fulfill the needs of a user having either a lower incoming mail volume or an incoming mail volume which is split between a number of different departments or operators. Further, due to office space limitations prevalent in many companies, there is a need for a relatively small sized mail extraction apparatus which can be readily integrated into an existing office environment and with existing incoming mail processing equipment, while requiring a minimum amount of space.

SUMMARY OF THE INVENTION

An object of the present invention is to provide a mail extraction apparatus which overcomes the deficiencies of prior art incoming mail processing equipment.

In particular, it is an object of the present invention to provide a mail extraction apparatus which is more versatile and yet less expensive than available mail extraction equipment.

It is another object of the present invention to provide a mail extraction apparatus which takes up less space than prior art mail extraction equipment.

The mail extraction apparatus in accordance with the present invention includes a mail opening and extraction assembly for opening an envelope along at least one edge of the envelope and spreading apart the envelope to facilitate removal of the contents of the envelope, and a power unit for providing a source of electricity and fluid pressure. The power unit is separate from the mail opening and extraction assembly and is coupled to the mail opening and extraction assembly by a supply line. As a result, the mail opening and extraction assembly can be readily placed on any type of available table or other surface, with the power unit being positioned under the table or in any other convenient available space.

The mail opening and extraction assembly includes an extraction station at which the envelope is spread apart by a pair of vacuum cups to facilitate the extraction of the contents of the envelope. A lower one of the vacuum cups is positioned on a pivotable extraction surface having a first position substantially flush with a transfer surface on which the envelope is transported to the extraction station, and having a second position in which the extraction surface is pivoted so as to be at an angle with respect to the transfer surface. When an envelope arrives at the extraction station, the pivotable extraction surface is pivoted into the second position and the vacuum cups spread apart the envelope to facilitate the extraction of the contents of the envelope by an operator. An upper vacuum cup on the end of a vacuum arm faces the pivotable extraction surface and contacts an upper face of the envelope. This vacuum arm is capable of moving in a direction away from the pivotable extraction surface to spread the faces of the envelope apart to facilitate extraction of the contents. The upper vacuum cup is pivotable about the axis of the vacuum arm so as to distort the envelope to further insure that the contents of the envelope are separated from the inside surfaces of the envelope, thereby further facilitating the extraction of the contents of the envelope.

The mail extraction apparatus of the present invention has a number of advantages due to its compact size and its ability to process a wide variety of sizes and thicknesses of mail. Further, the pivotable extraction surface at the extraction station facilitates the extraction of the contents of the envelope by making such contents readily viewable by an operator. In addition, the pivotable nature of the upper vacuum cup during the extraction process further separates the contents of the envelope from the inside surfaces of the envelope to ease the task of extracting the contents from the envelope.

These together with other objects and advantages, which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8 is a diagrammatic front view of a portion of the extraction station 56 illustrating the undulation produced in the envelope by a projection 110 on an extraction surface 59*a.

DESCRIPTION OF THE PREFERRED EMBODIMENTS

Figure 1:
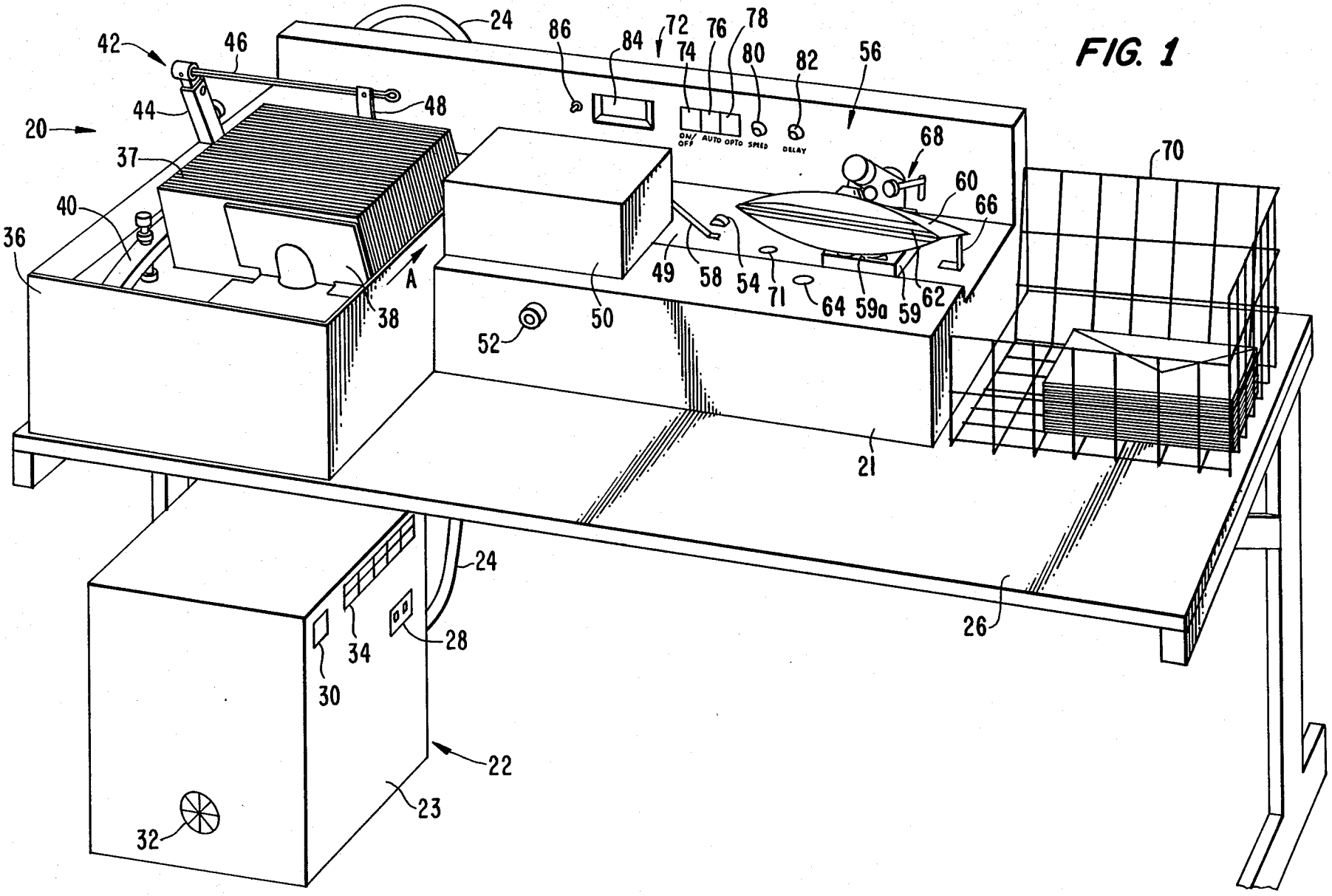
FIG. 1 is a perspective view of an embodiment of the present invention, with the apparatus of the invention being arranged on the surface of, and under, a table 26.

FIG. 1 is a perspective view of the table-top mail extraction apparatus of the present invention which includes a mail opening and extraction assembly 20, a power unit 22 and a supply line 24 which is coupled to the power unit 22 and the mail opening and extraction assembly 20. The mail opening and extraction assembly 20 has a housing 21, and the mail opening and extraction assembly 20 is a means for opening envelopes on at least one edge and for spreading apart the opened envelope to facilitate removal of the contents of the envelope. For convenience, the mail opening and extraction assembly 20 is illustrated as being placed on a small table 26 to show the compact and table-top nature of the mail opening and extraction assembly 20. However, in view of the relatively small size (119 cm (width)×71 cm (depth)×24 cm (height)) and weight (40 kg or approximately 88 pounds) of the mail opening and extraction assembly 20, it may be placed on any convenient and available surface having an area of at least 120 cm×80 cm. For example, it may be desirable to place the mail opening and extraction assembly 20 on the type of furniture which is currently used to support word processing equipment and other types of personal computer equipment. In this case, a table top level of 63 to 65 cm is ergonomically preferred. Alternatively, the mail opening and extraction assembly 20 may be custom fitted to its own small table or desk having a specially compartmented surface in which the mail opening and extraction assembly 20 will readily fit, or with hardware being used to attach the mail opening and extraction assembly 20 to the table or desk. One or more filing trays (not shown) may be conveniently attached to the table 26 or the mail opening and extraction assembly 20 in a position which is convenient for an operator to perform the filing function in conjunction with the mail extraction function.

The power unit 22 has a housing 23 which houses a power supply and an apparatus for supplying fluid pressure, which are used to provide sources of electricity and fluid pressure for driving the mail opening and extraction assembly 20. In the preferred embodiment, the apparatus for supplying fluid pressure is a vacuum pump. However, a source of compressed air or other type of pneumatic system may alternately be employed. The power unit 22 includes an electrical receptacle 28 for connection to any available electrical outlet, and an ON/OFF switch 30 for turning the power unit 22 ON and OFF. The power unit 22 also includes a fan 32 for maintaining the contents of the power unit 22 at the appropriate temperature, and ventilation louvres 34 for insuring proper air circulation in the power unit 22.

The supply line 24 acts as a means for transferring electricity and fluid pressure (e.g., vacuum pressure) from the power unit 22 to the mail opening and extraction assembly 20. Although the supply line 24 is illustrated as a single conduit for carrying both an electric power supply line and a vacuum line, it would of course be possible to have separate power and vacuum lines extending from the power unit 22 to the mail opening and extraction assembly 20. In either case, the supply line 24 has readily detachable connections to both the power unit 22 and the mail opening and extraction assembly 20. These readily detachable connections, which may include, for example, modular couplers, provide a quick disconnect between the supply line and the mail opening and extraction assembly 20 and between the supply line 24 and the power unit 22. As a result of the easily connectable/-detachable nature of the supply line 24 to/from the power unit 22 and the mail opening and extraction assembly 20, servicing and transportation of the components of the mail extraction apparatus of the present invention are enhanced. The supply line 24 is essentially an umbilical cord which allows the power unit 22 to be positioned in any adjacent available space. Therefore, while the power unit 22 is illustrated in a position under the table 26, the only constraint in the placement of the power unit 22 is the length of the supply line 24, so that the power unit 22 may actually be suspended from the ceiling or placed at a position more remote from the mail opening and extraction assembly. Like the mail opening and extraction assembly 20, the power unit 22 also has a relatively small size (35 cm (width)×41 cm (depth)×47.5 cm (height)) and weight (32 kg or approximately 70 pounds). Since the power unit 22 contains the power supply and the vacuum pump which are used to drive the mail opening and extraction assembly 20, the power unit 22 will be the primary source of objectionable noise and heat. Because the power unit is not constrained to be physically mounted with the mail opening and extraction assembly 20, annoyance to the operator due to such noise and heat can be kept to a minimum.

Referring to the mail opening and extraction assembly 20 of FIG. 1, a loading tray or feed hopper 36 is a means for storing unopened envelopes 37. The feed hopper 36 includes a propelling weight 38 which is positioned behind the stack of envelopes 37 and which is transported by a conveyor 39 (FIG. 3) in the direction of arrow A in FIG. 1. The feed hopper 36 also includes an adjustable guide 40 which is adjustably positioned adjacent one edge of the stack of envelopes 37. A retaining apparatus 42 is positioned adjacent the front end of the feed hopper 36 to ensure that only one envelope at a time is pulled from the feed hopper 36 by a feeding apparatus (described below). The retaining apparatus 42 includes an adjustable height bracket 44, a bar 46 and a retaining strap 48. The retaining strap 48 hangs from the bar 46 and overlaps by approximately 5 mm the envelope on the front of the stack of envelopes 37 in the feed hopper 36.

The mail opening and extraction assembly 20 includes a transfer surface 49 on which individual envelopes are transported by sliding the envelopes along the transfer surface 49, and a cutting unit 50 which acts as a means for opening at least one edge of each envelope as it is transported through the cutting unit 50. In the preferred embodiment, the cutting unit 50 is a slitting unit which cuts through only the bottom (i.e., lower) face of the envelope adjacent to one edge of the envelope as it is passed through the cutting unit 50. By slitting only the bottom face of the envelope, no waste material or chips are produced in the slitting process, so that there is no need for disposal of waste material and no potential for clogging the cutting unit 50. An adjustment knob 52 is provided on the cutting unit 50 to allow the operator to adjust the distance between the edge of the envelope and the slit in the bottom face of the envelope (i.e., the slitting width). The range of adjustment is between 0.8 and 4 mm. In the preferred embodiment, the distance between the edge of the envelope and the slit is set at approximately 1 mm to provide optimum protection against any cutting damage to the contents of the envelope.

A transport roller 54 transfers the slit envelope from the cutting unit 50 to an extraction station 56. A guide finger 58 insures that the slit open envelope contacts the transport roller 54 to ensure positive driving of the envelope to the extraction station 56. At the extraction station 56, a slit open envelope 60 is spread apart by vacuum cups (described below) to expose the contents 62 of the envelope for removal by an operator who is sitting or standing in front of and facing the extraction station 56. As the contents 62 are removed, the contents 62 are drawn across a photo-reflex scanner or photosensor 64 which detects the removal of the contents 62 from the envelope 60 in one mode of operation of the mail extraction apparatus of the present invention. The extraction station 56 includes a platen 59 with an extraction surface **59*a* having a first position in which it is flush with the transfer surface 49 and having a second position in which it is pivoted so as to be at an angle with respect to the transfer surface 49. A stop 66 halts the envelope 60 at a desired position in the extraction station 56. In an alternate embodiment, a photosensor 67 (FIG. 3) is provided in the transfer surface 49 to detect the length of each envelope as it passes over the photosensor 67. The position of the stop 66 is made adjustable, so that the distance between the stop 66 and the platen 59 is adjusted according to the length of the envelope. As a further alternate, a plurality of retractable stops can be located at different positions at the extraction station 56, and the proper stop for the length of envelope detected by the photosensor 67 can be actuated to properly position the envelope 60 at the extraction station 56. In a still further embodiment, the position of the stop 66 along the width of the envelope 60 may also be adjusted. The stop 66 insures the proper positioning of the vacuum cups (described below) on the faces of the envelope 60 at the extraction station 56, and the stop 66 is actuated when the envelope 60 triggers a photosensor 71 located on the transfer surface 49 at a position adjacent the platen 59. The stop 66 is lowered when the envelope 60 is spread apart at the extraction station 56. After the contents 62 of the envelope 60 have been extracted, an ejection device 68 (including a roller 68*a*), in combination with a roller 69 (FIG. 4) which protrudes through an aperture (not shown) in the platen 59 when the platen 59 is in its lower position, ejects the empty envelope 60 into a receiving bin 70. Alternatively, the empty envelope 60 may be ejected onto a conveyor for further processing. The details of the extraction station 56 will be described below with respect to FIGS. 4–8**.

The mail opening and extraction assembly 20 also includes a control panel 72 on the housing 21. The control panel 72 includes an ON/OFF switch 74, an AUTO switch 76, an OPTO switch 78, a speed control 80 and a delay control 82. The control panel 72 also includes a counter display 84 and a reset button 86 for the counter display. The counter display 84 is used to display the number of envelopes which have been processed by the mail opening and extraction assembly 20, and the reset button 86 is used to reset the counter display 84 to zero. The functions of the remaining portions of the control panel 72 are described below in connection with the description of the operation of the mail extraction apparatus of the present invention.

Figure 2:
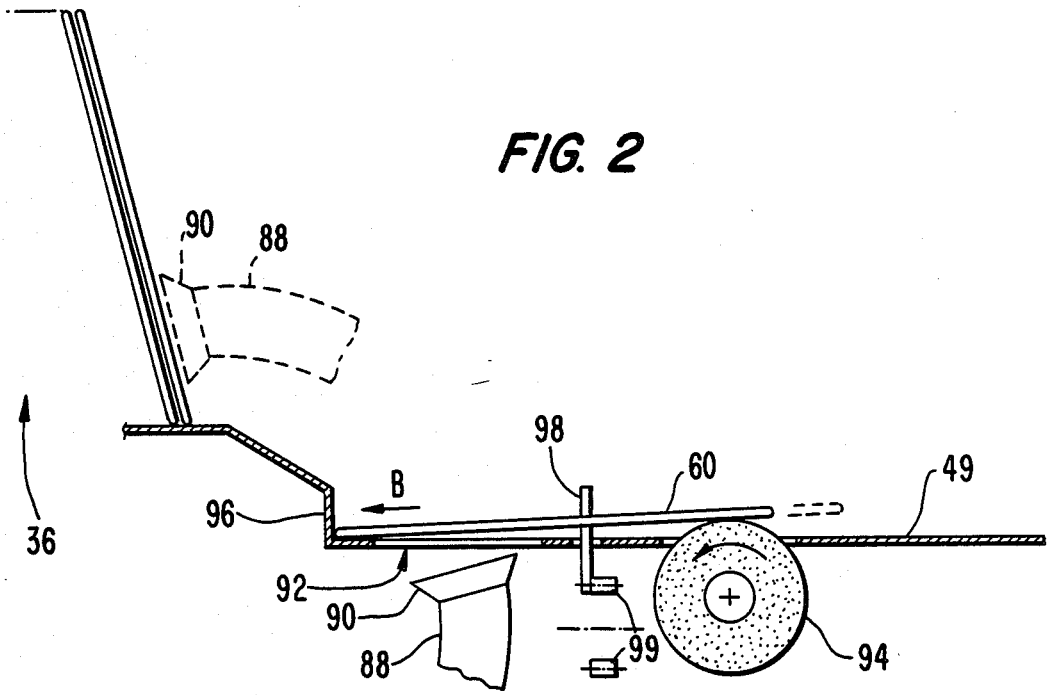
FIG. 2 is a diagrammatic sectional view of apparatus for feeding individual envelopes from a feed hopper 36 to a transfer surface 49.
Figure 3:
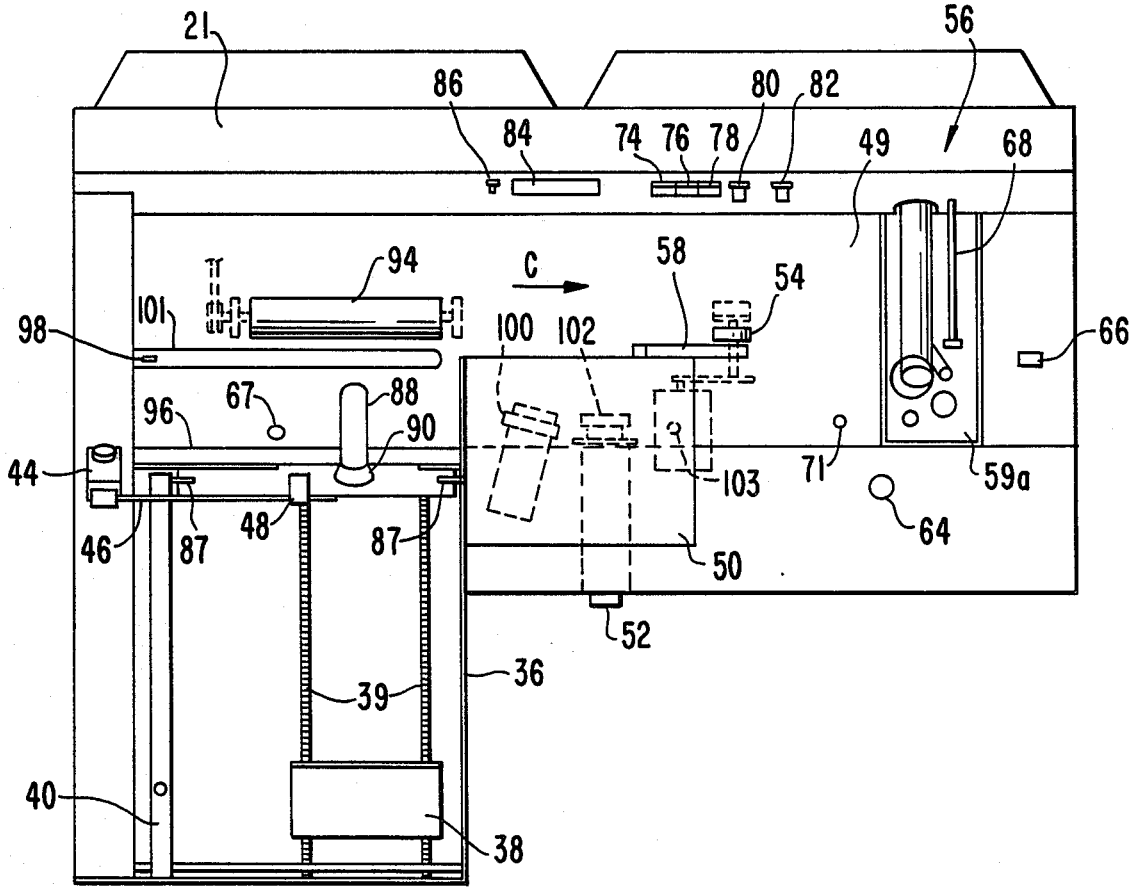
FIG. 3 is a plan view, partially in phantom and with envelopes removed, of the mail opening and extraction assembly 20 of FIG. 1.

FIGS. 2 and 3 best illustrate the feeding of envelopes from the feed hopper 36 to the transfer surface 49. Two retaining fingers 87 cooperate with the retaining strap 48 to hold the first envelope in the stack 37 in the feed hopper 36. One of the retaining fingers 87 is coupled to a photosensor (not shown) to detect when the envelope stack 37 is in position at the front of the feed hopper 36 and to thereby halt the movement of the conveyor 39. A vacuum arm 88 having a suction cup 90 at the end thereof, acts as a means for feeding individual envelopes from the envelope stack 37 in the feed hopper 36 to the transfer surface 49. In operation, the vacuum arm 88 is extended so that the suction cup 90 contacts an envelope 60 at the front of the envelope stack 37, and vacuum is applied to cause the front envelope 60 to be held by the suction cup 90 on the vacuum arm 88. The vacuum arm 88 is then retracted through a hole 92 in the transfer surface 49 so as to strip the envelope 60 from the suction cup 90 and deposit the envelope 60 on the transfer surface 49. After the envelope 60 contacts the transfer surface 49, a transport roller 94 causes the envelope 60 to be transported in the direction of arrow B in FIG. 2 so that the envelope 60 abuts a guide edge 96 of the transfer surface 49, thereby properly aligning the envelope 60 for feeding through the cutting unit 50. After the envelope 60 has been fed to the transfer surface 49, a dog or transportation finger 98 which is driven by a chain 99 and travels in a slot 101 in the transfer surface 49, contacts the trailing side edge of the envelope 60 to transport the envelope along the transfer surface 49 toward the cutting unit 50. The transfer surface 49 is substantially horizontal along its length to allow processing of letter formats ranging from 90 to 180 mm in width and up to 4 mm in thickness. This makes the mail opening and extraction assembly 20 substantially more versatile than prior art mail extraction machines which have a limited capability with respect to envelope width and thickness. Further, the transfer surface 49 presents a very straight, non-tortuous, and short path from the feed hopper 36 to the extraction station 56 as compared to prior art apparatus. By minimizing the distance between the feed hopper 36 and the extraction station 56, malfunctions due to improper transport of the envelope 60 through the cutting unit 50 can be minimized. The envelope 60 is transported in the direction of the arrow C in FIG. 3 along the guide edge 96 on which the cutting unit 50 is positioned. A feed roller 100 (illustrated by dotted lines in FIG. 3) inside the cutting unit 50 is at a slight angle to the guide edge 96 and ensures that the envelope 60 abuts the guide edge 96 of the transfer surface 49 in the cutting unit 50, while also feeding the envelope 60 to a cutting wheel 102 illustrated by dotted lines in FIG. 3. After the envelope 60 has been slit open along one edge by the cutting wheel 102, the transport roller 54 feeds the envelope 60 to the extraction station 56. As it passes out of the cutting unit 50, the envelope 60 triggers a photosensor 103 which senses the leading edge of each envelope and controls the counter. The photosensor 103 also provides a signal which causes the initiation of the operation of the extraction station 56.

Figure 4:
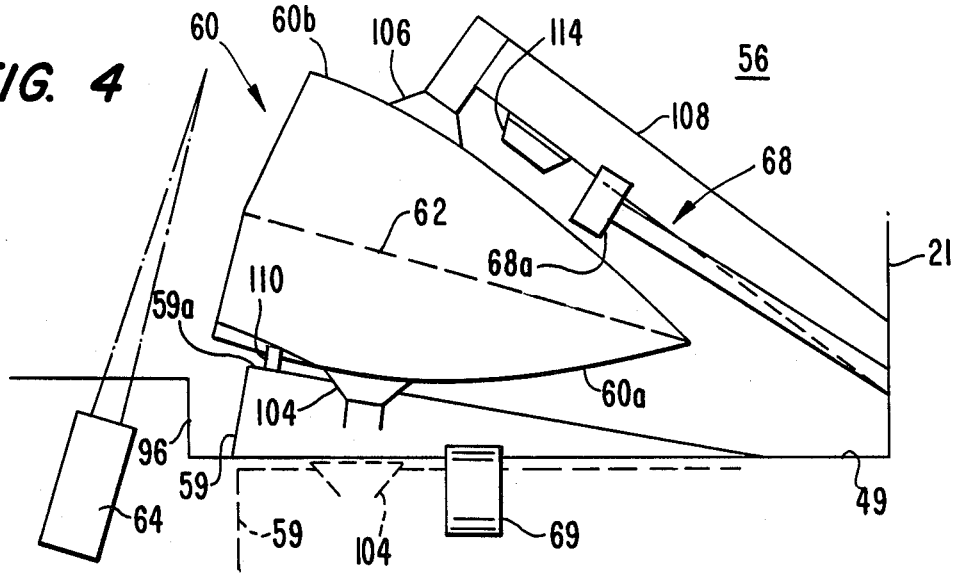
FIG. 4 is a diagrammatic sectional view of the extraction station 56 of the mail opening and extraction assembly 20 of FIG. 1.
Figure 5:
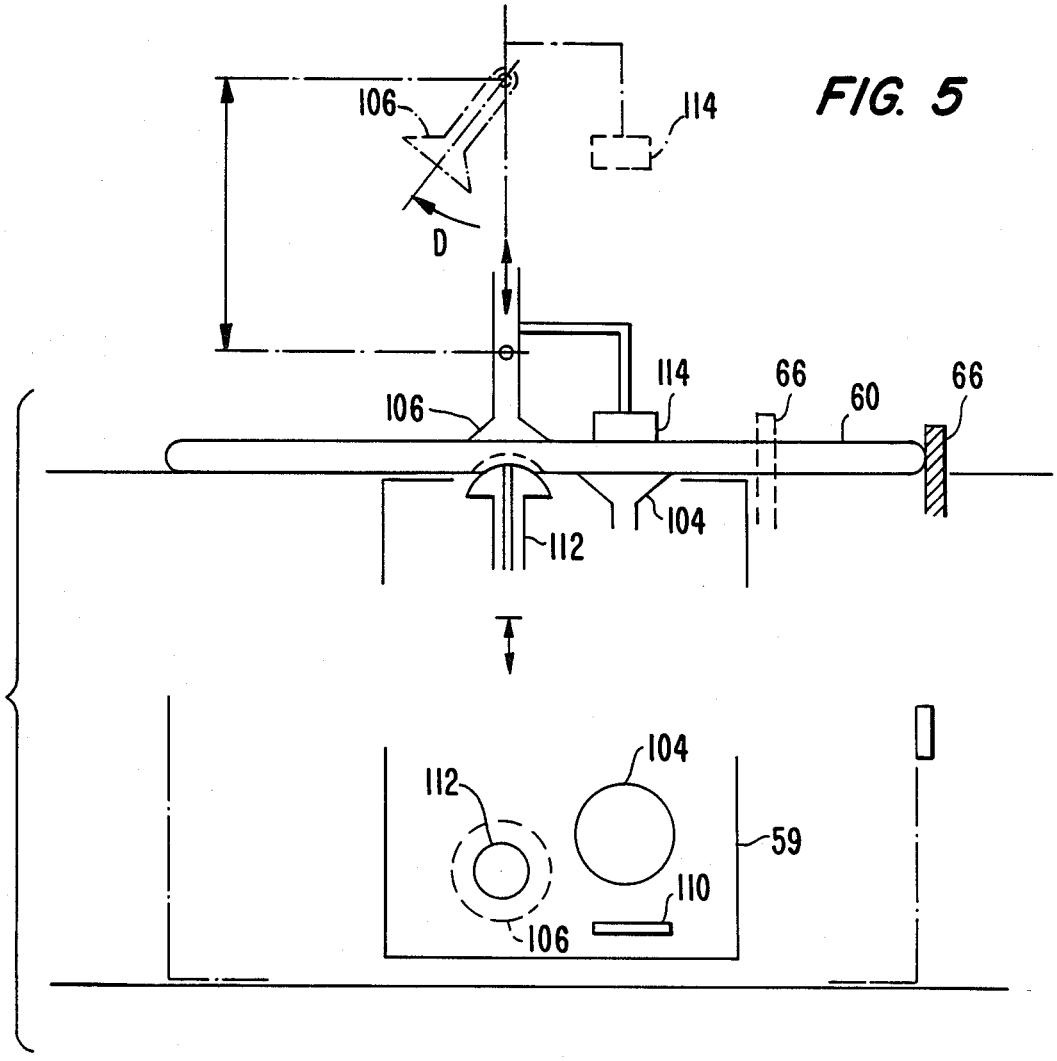
FIG. 5 is a diagrammatic front view of a portion of the extraction station 56 as seen by an operator.

The features of the extraction station 56 are best shown by the schematic drawings in FIGS. 4 and 5. Referring to FIG. 4, the extraction surface 59*a* has a suction cup 104 thereon for contacting a bottom face 60*a* of the envelope 60. The extraction station 56 further includes a vacuum cup 106 at the end of a vacuum arm 108 which extends from the housing 21. The vacuum arm 108 and vacuum cups 104 and 106 form a means for spreading apart an envelope to facilitate removal of its contents. The vacuum cup 106 is positioned to contact a top face 60*b* of the envelope 60. As is clear from the drawings, the vacuum cups 104 and 106 are staggered with respect to each other to avoid any possibility that the vacuum cups 104 and 106 will lock against each other in a case where extremely thin and porous envelopes are being processed. The extraction surface 59*a* also has a projection 110 extending therefrom to aid in the extraction process by distorting the bottom face 60*a* of the envelope 60. In addition, a contact switch 112 (which may be a microswitch, photocell, etc.) is carried by the extraction surface 59*a* (FIG. 5). When the envelope 60 arrives at the extraction station 56, the tabletop section 59 is in the position indicated by the dotted lines in FIG. 4. After the envelope 60 triggers the photosensor 103 (FIG. 3), the vacuum arm 108 is swung downward while the envelope 60 is being transferred into the extraction station 56. Therefore, just after the stop 66 halts the envelope 60 at the extraction station 56, the vacuum cup 106 comes into contact with the upper face 60*b* of the envelope 60. Meanwhile, the triggering of photosensor 71 has caused the stop to be raised and vacuum to be applied to the vacuum cups 104 and 106. The contact switch 112 is opposite the vacuum cup 106 so that it is triggered when the vacuum arm 108 has reached its lower end of travel, at which point the upper face 60*b* of the envelope 60 is in contact with the vacuum cup 106. When the contact switch 112 is triggered, the stop 66 is lowered, and simultaneously the platen 59 (and hence the extraction surface 59*a*) and the vacuum arm 108 are swung into their upward positions, thereby spreading apart the faces 60*a* and 60*b* of the envelope 60. That is, the extraction surface 59*a* swings out of its position substantially flush with the transfer surface 49 into an inclined position to make the task of removing the contents of the envelope easier for the operator. The platen 59 may be pivoted about an axle by any suitable drive apparatus, for example, a cam drive or a solenoid drive. The arrangement of the contact switch 112 on the extraction surface 59*a* is such that tripping of the switch 112 is always assured regardless of the envelope thickness. As illustrated in FIG. 4, a hold down member 114 is coupled to the vacuum arm 108 adjacent the vacuum cup 106 and opposite the vacuum cup 104 to ensure that the vacuum cup 104 is applied firmly to the lower face 60*a* of the envelope 60, to avoid any leaks upon the application of under pressure, and so that the vacuum cup 104 will firmly attach to the envelope 60.

Figure 6:
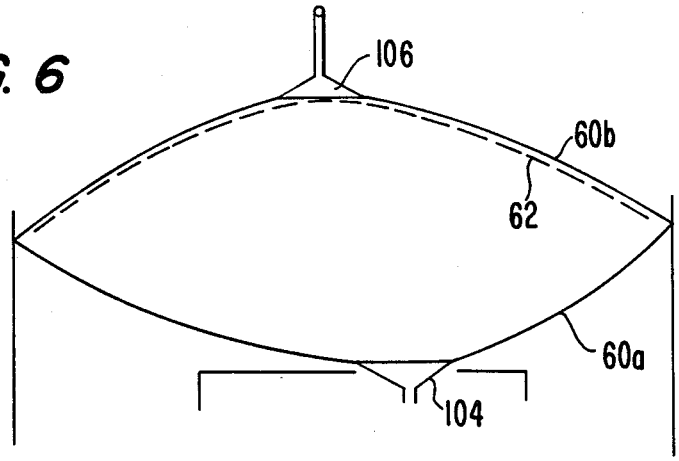
FIG. 6 is a diagrammatic front view of a portion of the extraction station 56 for illustrating the movement of the vacuum cups spreading apart an envelope.
Figure 7:
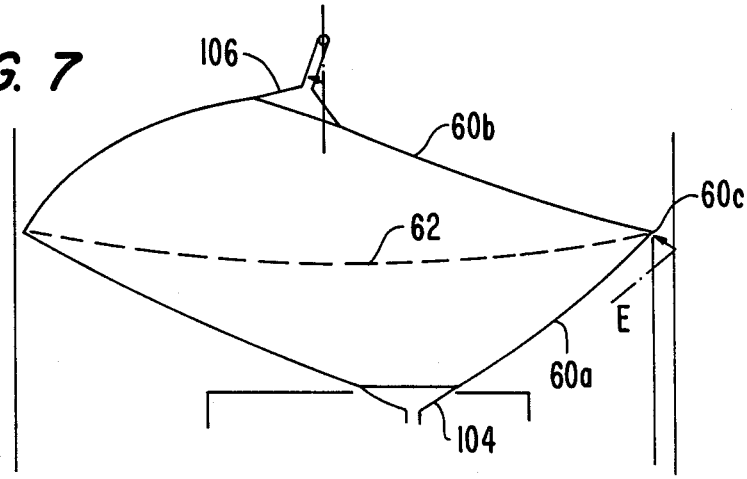
FIG. 7 is a diagrammatic front view of a portion of the extraction station 56 illustrating the pivoting movement of the upper vacuum cup causing a distortion in the spread apart envelope.
Figure 8:
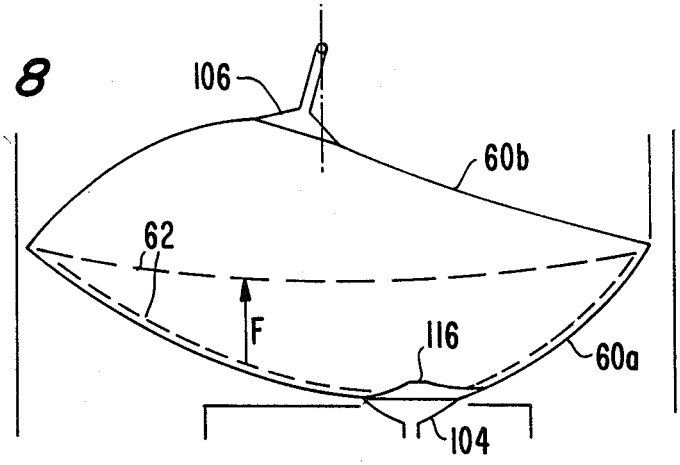
Figure 8:
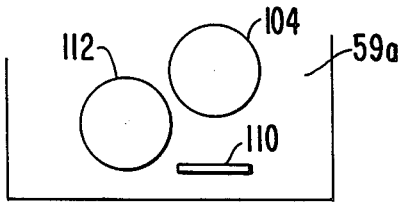

The movement of the vacuum cup 106 for facilitating the extraction of the contents 62 of the envelope 60 is best illustrated in FIGS. 5–8. Simultaneously with the upward movement of the vacuum arm 108 away from the extraction surface 59*a*, the vacuum cup 106 is pivoted about the axis of the vacuum arm 108 in the direction illustrated by arrow D in FIG. 5, thereby causing the opened envelope 60 to be distorted or corrugated in the manner illustrated in FIG. 7. The envelope 60 is held in this distorted position while extraction of the contents 62 of the envelope 60 takes place, thereby aiding in the separation of the contents 62 from the envelope 60. This distortion has a tendency of causing any of the contents 62 which are clinging to the inner sides of the envelope 60, as illustrated in FIG. 6 (e.g., as a result of vacuum leaks) to become detached from the inner sides of the envelope 60 and to assume a central position within the envelope as illustrated in FIG. 7. This makes it highly likely that an operator will be able to retrieve all of the contents 62 of the envelope 60 without missing any contents. The pivoting or swiveling action of the vacuum cup 106 simultaneously pulls an envelope edge 60*c* upwards as illustrated by arrow E in FIG. 7, so as to further urge any contents clinging to the inside of the upper face 60*b* of the envelope 60 to be detached. In addition, the projection 110 provided on the extraction surface 59*a* distorts the lower envelope face 60*a* into a supporting undulation 116 which tends to help force the contents away from the inner surface of the lower face 60*a* of the envelope in the direction of the arrow F in FIG. 8.

Figure 9:
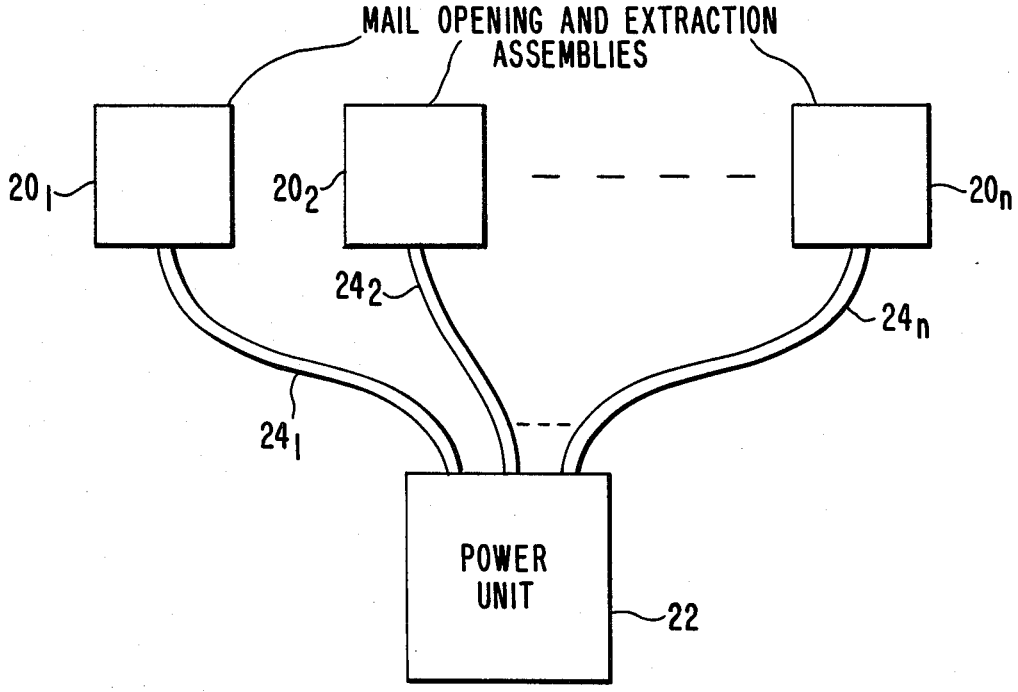
* and FIG. 9 is a block diagram of an alternate embodiment of the present invention in which a plurality of mail opening and extraction assemblies 20 are connected to a single power unit 22.

FIG. 9 is a block diagram of an alternate embodiment of the present invention in which a plurality of mail opening and extraction assemblies $\mathbf{20}_1$, $\mathbf{20}_2$ . . . $\mathbf{20}_n$ are provided with electricity and fluid pressure by a single power source 22 via plural supply lines $\mathbf{24}_1$, $\mathbf{24}_2$ . . . $\mathbf{24}_n$. This embodiment results in a further savings in space since a plurality of power units 22 are not required to operate multiple mail opening and extraction assemblies 20. This alternate embodiment is particularly suitable for a situation where a plurality of operators are to be located in adjacent areas, so that the plural mail opening and extraction assemblies could be readily connected to the single power unit 22.

The operation of the mail extraction apparatus of the present invention will now be described. Initially, the ON/OFF switch for the power unit 22 is turned ON so as to provide electricity and fluid pressure for the mail opening and extraction assembly 20. The ON/OFF switch 74 of the mail opening and extraction assembly 20 is also turned ON to place the mail opening and extraction assembly 20 in a stand-by mode. Envelopes to be processed are placed in a stack, sorted or mixed, in the feed hopper 36, and the guide 40 is adjusted for the width of the envelopes. In addition, the retaining apparatus 42 including the strap 48 is adjusted according to the height (i.e., width) of the envelope stack 37. After the feed hopper 36 is loaded, the propelling weight 38 is moved forward so as to position the front envelope in the stack 37 at the strap 48 and in contact with the retaining fingers 87. A photosensor (not shown) coupled to one of the retaining fingers 87 to detect when the envelope stack 37 is in the proper position. The conveyor 39 is driven until the stack 37 is in the proper position in the feed hopper 36. It should be noted that the feed hopper 36 can be reloaded at any time without stopping the apparatus.

The mail extracting apparatus of the present invention has both an AUTO mode and an OPTO mode. The operation of the present invention will first be described with respect to the OPTO mode. In the OPTO mode, cycling of the machine is triggered each time the contents 62 of an envelope 60 are removed from the envelope 60 and drawn across the photosensor 64. Therefore, in order to begin cycling of the machine, the operator will initially trigger the photosensor 64 by a momentary manual shading of the photosensor 64 (e.g., with a hand or paper) and the vacuum arm 88 will then feed an envelope 60 from the feed hopper 36 to the portion of the transfer surface 49 adjacent the aperture 92 for the vacuum arm 88. After the photosensor 64 is triggered again, the transportation finger 98 transports the envelope 60 to the cutting unit 50 and the envelope is then transported through the cutting or slitting unit 50 by the feed roller 100. The slit envelope 60 is then transported to the extraction station 56 by transport roller 54. While the envelope 60 is being transported to the extraction station 56 via the cutting unit 50, a next envelope 60' (not separately shown in the drawings) is fed from the feed hopper 36 to the transfer surface 49. At the extraction station 56, the stop 66 (which has been actuated by photosensor 71) halts the travel of the envelope 60 at the extraction station 56, and vacuum arm 108 (which has been actuated by photosensor 103) is lowered so that the vacuum cup 106 contacts the upper face **60*b* of the envelope 60 until the contact switch 112 is triggered. By this time, the photosensor 71 has triggered the application of vacuum by vacuum cups 104 and 106. When the contact switch 112 is triggered, the stop 66 is lowered, the platen 59 (and hence the extraction surface 59*a*) is pivoted upwardly, and the vacuum arm 108 is driven upwardly while the vacuum cup 106 is rotated about the axis of the vacuum arm 108 to distort the envelope. The readily accessible contents 62 of the envelope 60 are then extracted by the operator who pulls the contents 62 across the photosensor 64 to trigger the next cycle of operation. The delay control 82 is employed to vary the amount of time delay between the triggering of the photosensor 64 and the start of the next cycle of operation. The delay can be set to be for any time period between 0 seconds and 4 seconds to provide the operator additional time for a visual check to ensure the envelope 60 is empty. When the next cycle of operation begins, the application of vacuum pressure to the vacuum cups 104 and 106 is simultaneously cut off, the platen 59 is lowered to its rest position substantially flush with the transfer surface, the next envelope 60' is transported to the extraction station 56 via the cutting unit 50, and the emptied envelope 60 which was at the extraction station 56, is ejected out of the extraction station 56 and into the bin 70 by the ejection device 68 and the roller 69. The roller 68*a* of the ejection device 68 is positioned to press the empty envelope 60 against roller 69 which is rotating at a high rate of speed. At the same time, a further envelope 60'' (not shown separately in the drawings) is fed from the feed hopper 36 to the transfer surface 49. Operation continues in this manner, with each cycle being triggered by the contents 62 of an envelope 60 being drawn across the photosensor 64**. In the OPTO mode of operation, cycling is conducted at the pace set by the operator.

In the AUTO mode of operation, the cycling of the apparatus is not controlled via the photosensor 64; instead, cycling occurs at predetermined intervals set by the speed control 80. Cycling can be controlled so that an envelope is presented at the extraction station 56 at intervals between 1.2 seconds and 5 seconds. Thus, in theory, outputs ranging from 700 to 3000 cycles per hour can be achieved. In an alternate embodiment of the present invention, a pedal switch (not shown) is provided for use with the AUTO mode. When the pedal switch is pressed, the mail opening and extraction assembly 20 is immediately stopped after completing the current cycle, and is reactivated only when the pedal switch is released. The pedal switch allows the operator to respond instantly to any situation (e.g., a jam or incomplete extraction of contents) requiring stopping of the equipment, and is advantageous in that it does not require operators to use their hands to take such quick action.

The mail extraction apparatus of the present invention may be implemented in numerous ways. Any suitable type of pneumatic or hydraulic system may be used as the supply of fluid pressure provided by the power unit 22. The envelopes may be fed to the extraction station 56 using any known conveying apparatus, and any available apparatus for opening one or more edges of an envelope may be employed in place of the cutting unit 50. Although the transfer surface 49 is illustrated to be substantially horizontal, it is also possible to have the transfer surface 49 inclined at a slight angle with respect to the horizontal, with such incline being either toward or away from the operator. Further, although the vacuum cup 104 has been described as being positioned on the platen 59, the vacuum cup 104 may optionally be provided as a separate unit having a vacuum arm movable independently of the platen 59, and wherein the vacuum cup 104 is pivotable or movable with respect to its vacuum arm.

As is readily apparent from the above description, the portable table-top apparatus of the present invention has a number of advantages over the prior art. The apparatus of the present invention is readily integrated into existing incoming mail processing systems. The compact nature of the apparatus of the present invention allows great flexibility with respect to the selection of the exact work location for the apparatus and its arrangement and integration with available accessories such as sorting trays, staplers, daters, etc. This compact nature also allows the apparatus to be readily adapted to complement the customer's existing equipment location and space requirements. Further, the apparatus of the present invention is quite flexible with respect to the sizes and mix of mail which can be handled. For example, mail sizes between 89×127 mm and 180×250 mm and thicknesses up to a maximum of 4 mm, can be handled by the apparatus of the present invention. In addition, all of the operations performed by the apparatus of the present invention, beginning with the loading of the feed hopper 36 and ending with ejection into the bin 70, remain accessible to and in full view of the operator, so that the operator will be able to make any necessary minor corrections in response to a malfunction during operation of the equipment. The compact nature of the apparatus of the present invention also simplifies the task of servicing the equipment. For example, if it is necessary to service the apparatus of the present invention, the person servicing the equipment can make a quick check to determine whether servicing can be conducted in a minimum amount of time on site. If this is not possible, the small size of the components of the apparatus (i.e., the mail opening and extraction unit 20 and the power unit 22) will allow the service person to transport the malfunctioning piece of equipment (i.e., the power unit 22, the supply line 24, or the mail opening and extraction unit 20) back to the shop for repair, while leaving a loaner piece of equipment with the customer, so that the customer's operations are not interrupted due to such malfunction.

The many features and advantages of the invention are apparent from the detailed specification, and thus it is intended by the appended claims to cover all such features and advantages of the invention which fall within the true spirit and scope of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. Apparatus for facilitating extraction of the contents of envelopes, comprising:

first means for opening an envelope along at least one edge of the envelope and for spreading apart the opened envelope to facilitate removal of the contents of the envelope;

second means, separate from said first means, for providing a source of electricity and fluid pressure; and third means, coupled to said first and seconds means, for transferring the electricity and fluid pressure to said first means to drive said first means.

2. Apparatus for facilitating extraction of the contents of envelopes, comprising:

a mail opening and extraction assembly for opening an envelope along at least one edge of the envelope and for spreading apart the opened envelope to facilitate removal of the contents of the envelope;

a power unit for providing a source of electricity and fluid pressure;

a supply line, coupled to said mail opening and extraction assembly and said power unit, for transferring the electricity and fluid pressure to said mail opening and extraction assembly to drive said mail opening and extraction assembly.

3. Apparatus according to claim 2, wherein said mail opening and extraction assembly comprises:

a hopper for storing a plurality of envelopes;

a feeding apparatus for successively feeding individual envelopes from said hopper;

an opening unit for opening the individually fed envelopes along at least one edge; and an extraction station including vacuum apparatus for spreading apart the opened envelope to expose the contents of the envelope to facilitate removal of the contents.

4. Apparatus according to claim 3, further comprising a transfer surface extending from said feeding apparatus to said extraction station, across which the envelopes are transported in succession.

5. Apparatus according to claim 4, wherein said extraction station comprises a pivotable extraction surface having a first position substantially flush with said transfer surface and having a second position in which said extraction surface is pivoted so as to be at an angle with respect to said transfer surface, said pivotable extraction surface being substantially planar when in the first and second positions.

6. Apparatus according to claim 5, wherein each of the envelopes has first and second faces and wherein said vacuum apparatus comprises:

a first vacuum cup on said pivotable extraction surface for contacting the first face of the envelope; and a second vacuum cup, positioned opposite said extraction surface, for contacting the second face of the envelope which is opposite the first face.

7. Apparatus according to claim 6, wherein said vacuum apparatus further comprises a vacuum arm extending from said second vacuum cup, wherein said vacuum arm is movable in a direction away from said pivotable extraction surface and wherein said second vacuum cup is rotatable about the axis of said vacuum arm so as to distort the envelope which is being spread apart at the extraction station to facilitate the removal of the contents of the envelope.

8. Apparatus according to claim 7, wherein said extraction station further comprises a projection extending from said pivotable extraction surface, and wherein said projection produces an undulation in the first face of the envelope which is being spread apart at said extraction station to facilitate the removal of the contents of the envelope.

9. Apparatus according to claim 8, further comprising a retractable stop positioned on said transfer surface adjacent said extraction station, for positioning the envelope at the extraction station.

10. Apparatus according to claim 9, wherein said transfer surface is substantially horizontal.

11. Apparatus according to claim 9, wherein said transfer surface is at an angle with respect to the horizontal.

12. Apparatus according to claim 2 further comprising:

at least one additional mail opening and extraction assembly for opening an envelope along at least one edge of the envelope and for spreading apart the opened envelope to facilitate removal of the contents of the envelope; and at least one additional supply line coupled to said power unit and said at least one additional mail opening and extraction assembly and said power unit, for transferring the electricity and fluid pressure to said at least one additional mail opening and extraction assembly to drive said at least one additional mail opening and extraction assembly.

13. Apparatus for facilitating extraction of the contents of envelopes, comprising:

a mail opening and extraction assembly including:
means for storing a plurality of envelopes;
means for successively feeding individual envelopes from said storing means;
means for opening each individually fed envelope along at least one edge; and
extraction means for spreading apart the opened envelope to expose the contents of the envelope to facilitate removal of the contents;
a power unit for providing a source of electricity and fluid pressure; and
a supply line, coupled to said mail opening and extraction assembly and said power unit, for transferring the electricity and fluid pressure to said mail opening and extraction assembly to drive said mail opening and extraction assembly.

14. Apparatus according to claim 13, further comprising a transfer surface extending from said feeding means to said extraction means, across which the envelopes are transported in succession, wherein said extraction means further comprises:
means for elevating at least a portion of the opened envelope above said transfer surface; and
means for spreading apart the opened envelope to expose the contents of the envelope.

15. Apparatus according to claim 13, wherein each of the envelopes has first and second faces and wherein said extraction means further comprises:
a first vacuum cup for contacting the first face of the envelope;
a second vacuum cup for contacting the second face of the envelope; and
a vacuum arm extending from said second vacuum cup, wherein said vacuum arm is movable in a direction away from the extraction surface, and wherein said second vacuum cup is rotatable about the axis of said vacuum arm so as to distort the envelope which is being spread apart at the extraction station to facilitate the removal of the contents of the envelope.

16. Apparatus according to claim 15, further comprising means for automatically cycling the apparatus when the contents is removed from the envelope.

17. Apparatus according to claim 16, wherein said automatic cycling means comprises a photosensor triggered when the contents of the envelope is removed.

18. Apparatus according to claim 16, wherein said means for opening the individually fed envelopes comprises means for slitting the envelope along the at least one edge of the envelope.

19. Apparatus according to claim 18, further comprising means for adjusting the distance between the edge of the envelope and the adjacent slit in the envelope.

20. Apparatus according to claim 14, wherein each of the envelopes has first and second faces and wherein said extraction means further comprises:
a first vacuum cup for contacting the first face of the envelope;
a second vacuum cup for contacting the second face of the envelope; and
a vacuum arm extending from said second vacuum cup, wherein said vacuum arm is movable in a direction away from the extraction surface, and wherein said second vacuum cup is rotatable about the axis of said vacuum arm so as to distort the envelope which is being spread apart at the extraction station to facilitate the removal of the contents of the envelope.

21. An extraction station for an apparatus for facilitating extraction of the contents of envelopes opened along at least one edge and transported on a transfer surface, comprising:
a pivotable extraction surface having a first position which is substantially flush with the transfer surface and having a second position in which the extraction surface is pivoted so as to be at an angle with respect to the transfer surface, said pivotable extraction surface for supporting an opened envelope and being substantially planar when in both the first and second positions; and
vacuum apparatus for spreading apart the opened envelope while said pivotable extraction surface supports the opened envelope in the second position to expose the contents of the envelope for removal.

22. Apparatus according to claim 21, wherein each of the envelopes has first and second faces and wherein said vacuum apparatus comprises:
first vacuum means on said extraction surface for contacting the first face of the envelope; and
second vacuum means, positioned opposite said pivotable extraction surface, for contacting the second face of the envelope which is opposite the first face, said second vacuum means being movable toward and away from said pivotable extraction surface, said second vacuum means also being rotatable about an axis which is substantially parallel to said pivotable extraction surface so as to distort the envelope which is being spread apart at said extraction station to facilitate the removal of the contents of the envelope.

23. Apparatus according to claim 22, wherein said first vacuum means comprises a first vacuum cup, wherein said second vacuum means comprises a second vacuum cup and a vacuum arm extending from said second vacuum cup, wherein said vacuum arm is movable in a direction away from said pivotable extraction surface and wherein said second vacuum cup is rotatable about the axis of said vacuum arm so as to distort the envelope which is being spread apart at said extraction station to facilitate the removal of the contents of the envelope.

24. Apparatus according to claim 22, wherein said first vacuum means is connected to said pivotable extraction surface and is movable with said pivotable extraction surface.

25. Apparatus according to claim 22, wherein said first vacuum means is movable independently of the movement of said pivotable extraction surface.

26. Apparatus according to claim 21, further comprising a contact switch on said pivotable extraction surface, said contact switch being actuated by the movement of said second vacuum means to indicate that said second vacuum means is in contact with the envelope.

27. Apparatus according to claim 22, further comprising at least one stop adjacent said pivotable extraction surface for positioning the envelope on said pivotable extraction surface.

28. Apparatus according to claim 22, further comprising a projection extending from said pivotable extraction surface, wherein said projection produces an undulation in the first face of the envelope which is being spread apart by said vacuum apparatus, to facilitate the removal of the contents of the envelope.

29. Apparatus according to claim 21, further comprising a guide edge, adjacent said pivotable extraction surface, and a removal surface extending from said guide edge, a portion of said pivotable extraction surface being substantially level with said removal surface when said pivotable extraction surface is in the second position.

* * * * *